United States Patent [19]

Glaser et al.

[11] 4,009,772

[45] Mar. 1, 1977

[54] MOSAIC PRINTING HEAD

[75] Inventors: Wolfgang Glaser; Peter Krischke, both of Karlsruhe; Walter Steinbach, Donaueschingen; Hans Joachim Steinmetz, Grunwettersbach, all of Germany

[73] Assignee: Steinmetz Krischke Systemtechnik GmbH, Germany

[22] Filed: Aug. 19, 1974

[21] Appl. No.: 498,527

[30] Foreign Application Priority Data

Aug. 22, 1973 Germany ..... 2342420

[52] U.S. Cl. ..... 197/1 R

[51] Int. Cl.[2] ..... B41J 3/04

[58] Field of Search ..... 197/1 R; 101/93.04; 335/297

[56] References Cited

UNITED STATES PATENTS

| | | | |
|---|---|---|---|
| 2,504,996 | 4/1950 | MacDonald | 335/297 X |
| 3,802,543 | 4/1974 | Howard | 197/1 R |
| 3,828,908 | 8/1974 | Schneider | 197/1 R |
| 3,835,975 | 9/1974 | Howard | 197/1 R |
| 3,842,955 | 10/1974 | Iwasaki | 197/1 R |
| 3,854,564 | 12/1974 | Flaceliere et al. | 197/1 R |

FOREIGN PATENTS OR APPLICATIONS

| | | | |
|---|---|---|---|
| 2,119,641 | 11/1972 | Germany | 197/1 R |

*Primary Examiner*—Anton O. Oechsle
*Attorney, Agent, or Firm*—Perry Carvellas

[57] ABSTRACT

In a mosaic printing head for applying lettering by means of needles which are ejected as the head is passed over a sheet of paper, the needles are accommodated in a tubular column of bearing metal. Near one end, the tube is formed with a transverse wall containing a circular arrangement of guide holes for the needles, each guide hole being slightly inclined towards the tube axis. The operative ends of the needles are arranged in a row and parallel to one another with the aid of an orifice member provided for the tube.

8 Claims, 8 Drawing Figures

MOSAIC PRINTING HEAD

The invention relates to a mosaic printing head comprising a plurality of printing needles passed through a central supporting column. Electromagnets having armatures hinged by one end to the yokes are generally arranged concentrically about the supporting column. The free ends of the armatures act on the upper or inoperative ends of the printing needles to eject the lower or operative needle ends which are arranged in a row.

Such printing heads are passed line by line over the paper to be marked. During marking, the paper or the printing head may be held stationary. The printing head wanders continuously over the writing paper and forms the characters by electronically controlled ejection of the aligned printing needles. The height of the characters is determined by the length of the row of printing needles and the width of every marked character is determined by the number of printing points allocated to the character in a row. Generally, the characters are formed by 7 × 5, i.e. 35 printing points, or 9 × 7, i.e. 63 printing points. The printing head may be passed continuously at a constant speed over the length of the line to be printed or, when writing individual letters, for example scanned letters, the printing head may always move along a distance equivalent to the width of only one letter. Since the printing needles are ejected whilst there is relative movement between the paper and the printing head, it is necessary, particularly in order to achieve high writing speeds, to set the individual printing points during very small time intervals so that the resulting character will be clean and sharp. For this purpose, high requirements are set for the magnetic system as well as for guiding the printing needles in the printing head.

Known moving coil mosaic printing heads in a fan arrangement have a high penetration force because of the large mass of the moving coil or armature connected to the printing needles and consequently many copies can be produced. Disadvantages of these known printing heads are that the inertia of the system causes a longer printing operation, undesirable friction and high wear are produced by the needles which are bent to a small radius, and the number of printing needles is limited by the progressively smaller bending radius of the printing needles when further printing needles are added. An improvement has been achieved by disposing the printing needles and their actuating magnets radially, thereby making it possible to reduce the bending radius of the printing needles considerably.

In a mosaic printing head known from U.S. Pat. No. 3,467,232, where the needles are arranged radially, the needles are as rigid as possible and guided rectilinearly whilst driven by a moving coil. Flexure of the needles is therefore avoided but the needles are inclined to the centre line of the printing head at the position where they project from the head. Use of the moving coils makes the known printing head too inert for high writing speeds.

In a mosaic printing head known from French Specification 2,094,311, wherein the printing needles are arranged radially and driven by electromagnets having hinged armatures, the needles are for the greater part of their length guided in flexible tubes and therefore subjected to high friction by the walls of the tubes.

Another mosaic printing head using magnets with hinged armatures and a radial arrangement of the printing needles is disclosed in German Specification 2,110,410. The needles are guided only at their operative or printing ends and thus the needles are subjected to undesirable oscillations or vibratory effects, especially at high writing speeds.

In German Specification 2,056,364, which also relates to a mosaic printing head, there is no disclosure at all about suitable guiding of the printing needles.

It is an object of the present invention to provide a readily assembled mosaic printing head of simple construction, wherein the printing needles can be ejected parallel to one another and are guided with a minimum of friction.

The invention provides a mosaic printing head comprising a plurality of printing needles disposed in a supporting column and operating means around said column effective to act on said needles to eject the operative ends thereof from said column, wherein said supporting column comprises a tube having a transverse wall of bearing metal near one end thereof, said wall being provided with a plurality of guide holes having their axes arranged concentrically about the longitudinal axis of said tube and extending at a slight inclination to said tube axis, each of said needles passing through a respective one of said guide holes, and wherein the other end of said tube is provided with an orifice member having means for guiding said needles parallel to one another in a row. The transverse wall is preferably made in one piece with said tube, the whole of which is therefore made of bearing metal, and said orifice member is preferably made separately and subsequently inserted in said other end of said tube.

In the mosaic printing head according to the invention, therefore, the printing needles are disposed in a unitary central member which can be readily mounted on a plate or in a housing with electromagnets for actuating the needles being suitably arranged around the central member. Manufacturing costs are considerably reduced by reason of the tubular supporting column being made of bearing metal, for example bearing bronze, so that there will be a minimum of frictional forces exerted on the needles. Only very little curvature is required over the length of the needles and consequently the frictional forces are only slightly increased by the bearing reactions arising out of this curvature. The orifice member provided with the means for guiding the needles near the operative ends of the latter need only once be inserted and adjusted in the tube.

The printing head according to the invention permits high writing speeds to be obtained. If the impulse frequency energising the electromagnets is doubled, the printing points in the lines can be moved in half-steps. Thus, when using a bank of 9 × 9, the quality of the printed characters can be considerably improved.

The tube may contain a guide member intermediate its ends, the guide member also being of bearing metal and containing a plurality of bores arranged in an elipse about the tube axis for receiving the printing needles. This intermediate guide member improves the oscillatory behaviour of the printing needles, which can be important at the high impulse frequencies that are employed.

For the purpose of guiding the printing needles in a parallel arrangement at the orifice end of the supporting tube, the aforementioned guiding means may comprise tubular or segmented shell guides having a radius conforming to the needle diameter. These guides are preferably provided in a single article. Alternatively, the guiding means may comprise spaced parallel plates each containing a row of apertures for the passage of the needles. In yet another construction the guiding means may comprise divided plates provided at their confronting sides with recesses conforming to the diameter of the needles. To permit a close sequence of needles projecting from the orifice member, the guiding means are preferably segmented bearing shells which guide the printing needles only at opposed circumferential regions thereof so that they can touch one another along the segmental axis.

To minimise wear of the guiding means provided in the orifice member, they are preferably made of ruby.

In one form of the invention, the end portion of the tube remote from that containing the transverse wall is provided with an inserted sleeve, the inserted end of the sleeve containing the guide member having the eliptical arrangement of bores for the needles and the other sleeve end containing the orifice member in which the needles are guided in a parallel arrangement. If, as is preferred, the operating means comprise electromagnets having armatures which are each hinged at one end, then an annular collar is provided on the tube adjacent the inoperative ends of the printing needles, the collar containing guide slots for the unhinged ends of the armatures. Such a construction not only centres the armatures but, since the collar will also be of bearing metal, the armatures are additionally guided in the slots with a minimum of friction.

An example of the invention will now be described with reference to the accompanying drawings, wherein.

Figure 1:
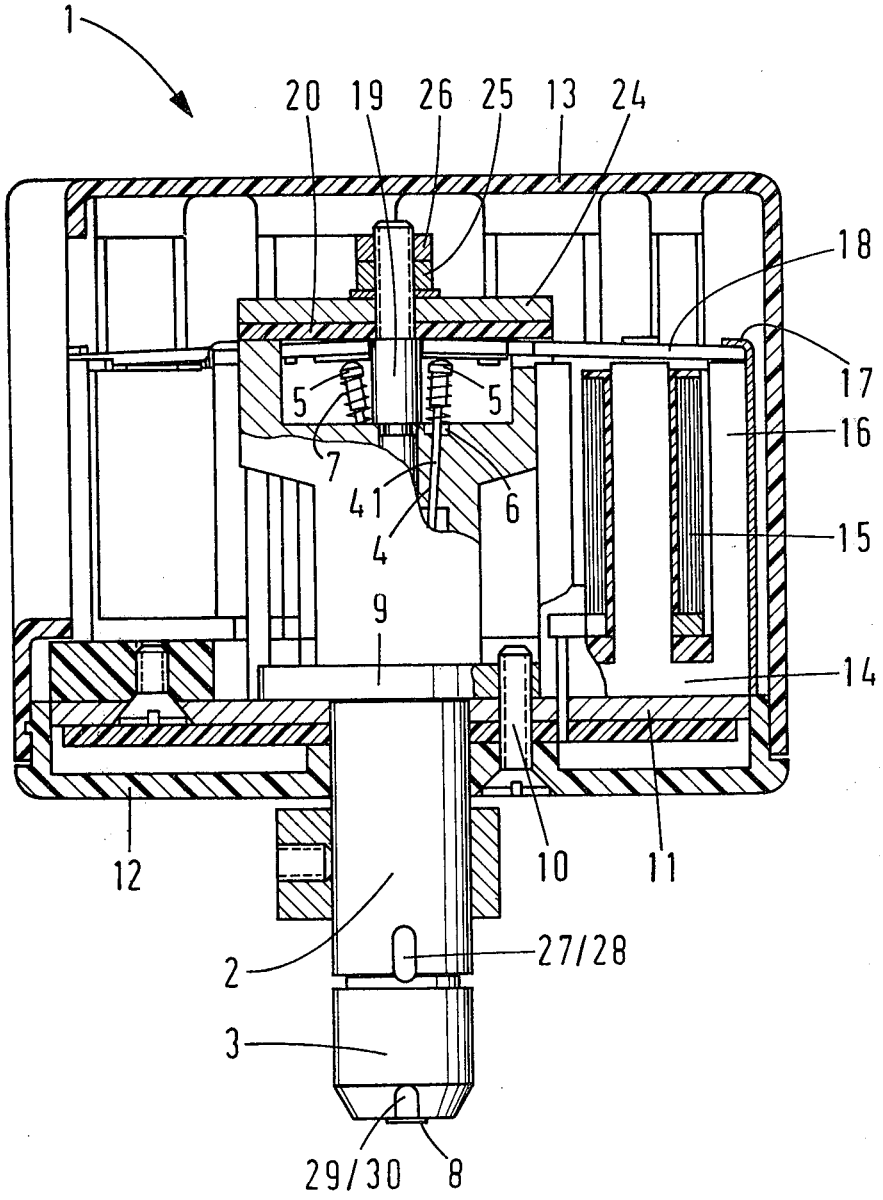
FIG. 1 is a part-sectional side elevation of a mosaic printing head.
Figure 2:
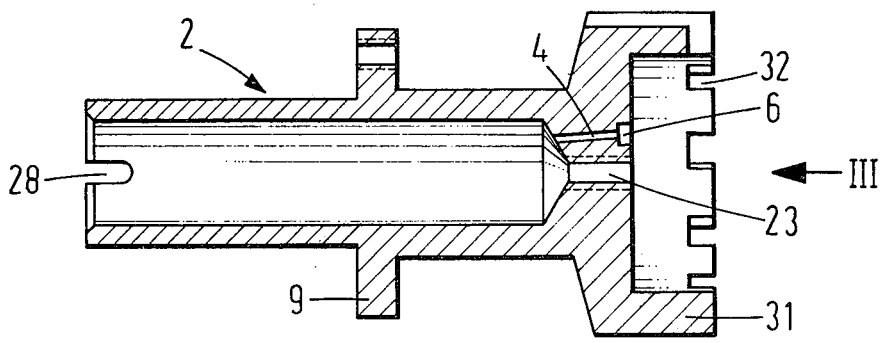
FIG. 2 is a longitudinal section on the line II — II in FIG. 3 through the central tubular supporting column of the FIG. 1 printing head.
Figure 3:
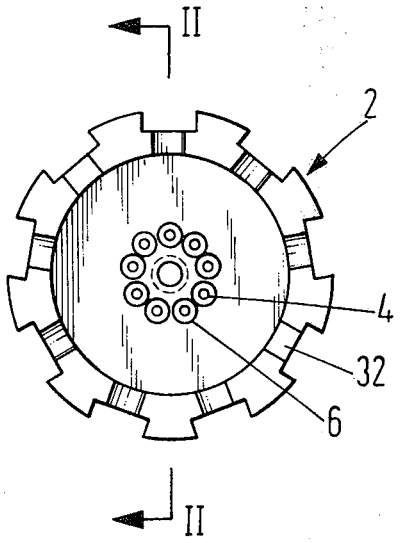
FIG. 3 is a plan view taken in the direction of the arrow III in FIG. 2.
Figure 4:
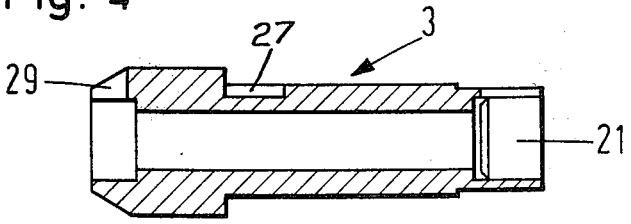
FIG. 4 is a longitudinal section through a sleeve for insertion in the FIG. 2 column.
Figure 5:
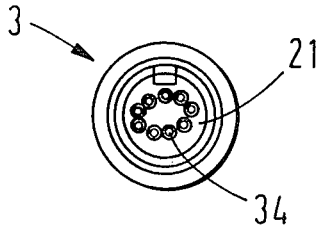
FIGS. 5 and 6 are respectively a plan and underplan of the FIG. 4 sleeve.

The mosaic printing head generally indicated at 1 in FIG. 1 is built up around a central tubular supporting column 2 (also see FIGS. 2 and 3). The column 2 contains an inserted sleeve 3 of which the inserted end that is not visible in FIG. 1 contains a guide member 21 (FIGS. 4 and 5). At its upper end, the column or tube 2 is provided with an internal transverse wall containing a plurality of guide holes 4 which are slightly inclined to the longitudinal axis of the tube 2 and through which printing needles 41 are passed. The lower or operative ends 8 of the needles 41 project by a short distance in a straight row out of an orifice member 22 (FIGS. 7 and 8) which is inserted in the sleeve 3. At their upper or inoperative ends, the needles 41 are provided with heads 5. Between these heads 5 and emplacements 6 (FIG. 3) provided at the entrances to the guide holes 4 there are compression springs 7 which are effective to push the heads 5 of the needles 41 against hinged armatures 18 of electromagnets that are disposed concentrically about the tube 2.

The tube 2 is provided with an annular collar 9 by which it is secured to a base plate 11 with the aid of countersunk screws 10 which also serve to mount the base plate 11 in a housing portion 12. The base plate 11 also supports the electromagnets, each of which comprises a laminated iron yoke 14, a coil 15 and the aforementioned hinged armature 18. Each armature extends substantially radially with respect to the tube 2 and is hinged at one end between a yoke portion 16 and a clip 17.

A central tapped hole 23 in the transverse wall of the tube 2 is engaged with the screw-threaded end of a stud 19. The other end of the latter is also screw-threaded for engagement with nuts 25, 26 which serve to secure to the tube 2 a cushion or padding 20 and a backing or retaining plate 24. By reason of the compression springs 7, the needle heads 5 press the unhinged ends of the armatures 18 against the cushion 20. Each armature is therefore in contact with an associated needle without any play.

At its lower end, the tube 2 contains a notch 28 which, on assembly, is brought into registry with a groove 27 in the sleeve 3. After the distance by which the ends 8 of the needles 41 project from the orifice member 22 has been set, the sleeve 3 and the tube 2 are interconnected by introducing an adhesive in the aligned groove 27 and notch 28.

The yoke 14 of the electromagnet is laminated to avoid eddy currents and consequent undesirable heating of the iron. After assembly of the components of the printing head, a cover or housing portion 13 is snapped into engagement with the housing portion 12.

From the enlarged detail views of the tube 2 in FIGS. 2 and 3, it will be seen that the aforementioned collar 9 is provided on a shank portion of the tube which extends into an annular tubular collar 31 of which the edge remote from the transverse wall in which the holes 4 are formed contains slots 32 for guiding the unhinged ends of the armatures 18. FIGS. 2 and 3 also more clearly show the countersunk portions 6 of the holes 4 that serve as emplacements for the compression springs 7 described in connection with FIG. 1.

Figure 6:
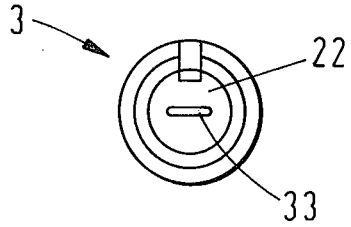

The aforementioned sleeve 3 for insertion in the tube 2 is shown in greater detail in FIGS. 4 to 6. At an enlarged end which normally projects from the tube 2, the sleeve 3 is provided with a slot 29 which, during assembly of the printing head, is brought into registry with a groove 30 of the orifice member 22, whereafter adhesive is introduced to interconnect the sleeve and orifice member. Inserted in the other end of the sleeve 3 there is the aforementioned guide member 21 of bearing metal provided with a plurality of bores 34 arranged in an elipse (FIG. 5). The slit through which the printing needles 41 project from the orifice member 22 is best seen at 33 in FIG. 6.

Figure 7:
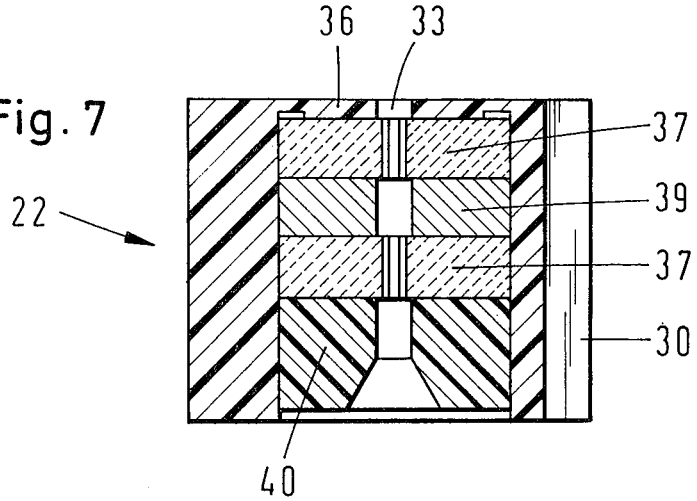
FIG. 7 is a longitudinal section through an orifice member for the FIG. 2 column.
Figure 8:
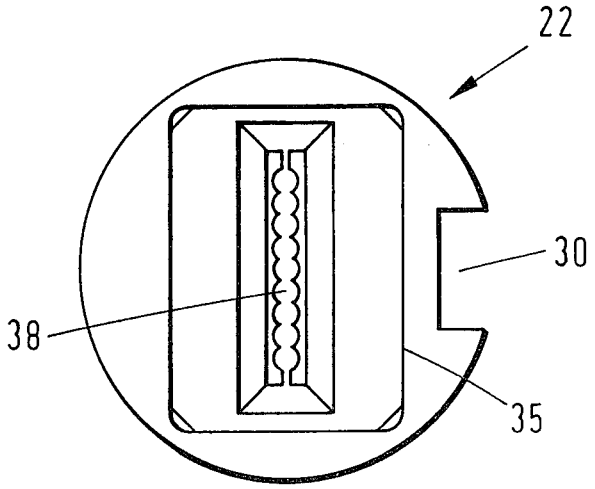
FIG. 8 is a plan view of the orifice member taken from the side of entry.

Referring to the enlarged views in FIGS. 7 and 8 of the orifice member 22 which is inserted in the end of the sleeve 3 adjacent the slot 29, it will be evident that the orifice member is substantially circular cylindrical. It is preferably made from plastics material and contains a cavity 35 of rectangular cross-section. The end wall 36 of the orifice member is provided with the aforementioned slit 33 for the passage of the printing needles. The cavity 35 contains two parallel ruby plates 37 on each side of a spacer 39. Each plate 37 contains nine bearing apertures 38. A centering member 40 closes off the cavity 35.

I claim:

1. A mosaic printing head comprising a plurality of printing needles each having a tip and a base and disposed in a tubular supporting column, and operating means provided around said column and selectively actuatable to act on the needle bases to project the needle tips from said column, wherein said supporting column comprises a transverse wall of bearing metal near one end thereof, said wall being provided with a plurality of first guide holes receiving said needles adjacent their bases, said first guide holes having their axes arranged in a circle concentrically about the longitudinal axis of said column and extending at a slight inclination to said column axis, wherein the other end of said column is provided with an orifice member having means for guiding said needles adjacent their tips so as to extend parallel to one another in a row, and wherein said column contains a guide member intermediate its said ends, said intermediate guide member being of bearing metal and containing a plurality of second guide holes arranged in an ellipse about said column axis for receiving said needles, said intermediate guide member and orifice member being held in opposite ends of a sleeve insertable in said column.

2. A printing head according to claim 1, including means for securing the sleeve against rotation in the column.

3. A printing head according to claim 1, wherein said transverse wall is made in one piece with said column.

4. A printing head according to claim 1, wherein said guiding means of said orifice member comprise spaced parallel plates each containing a row of apertures for the passage of said needles.

5. A printing head according to claim 1, wherein said guiding means of said orifice member are of ruby.

6. A printing head according to claim 1, wherein said column comprises an annular collar disposed at said one end concentric with said column axis and said operating means comprise electromagnets having armatures which are each hinged at one end, said collar containing guide slots for the unhinged ends of said armatures.

7. A printing head according to claim 6 including a coil spring on each needle effective to urge the needle base against a respective armature, and emplacements in the transverse wall for supporting the springs.

8. A printing head according to claim 1, including a mounting plate, and a collar intermediate said column ends for securing said column to said mounting plate.

* * * * *